US008100470B1

(12) United States Patent
Hu

(10) Patent No.: US 8,100,470 B1
(45) Date of Patent: Jan. 24, 2012

(54) CHILD CHAIR HAVING ENGAGING ASSEMBLY FOR SEAT

(75) Inventor: Jun-Jie Hu, Central (HK)

(73) Assignee: Wonderland Nurserygoods Company Limited, Central (HK)

( * ) Notice: Subject to any disclaimer, the term of this patent is extended or adjusted under 35 U.S.C. 154(b) by 0 days.

(21) Appl. No.: 13/277,204

(22) Filed: Oct. 19, 2011

Related U.S. Application Data

(62) Division of application No. 12/486,729, filed on Jun. 17, 2009.

(60) Provisional application No. 61/091,724, filed on Aug. 25, 2008, provisional application No. 61/140,973, filed on Dec. 28, 2008, provisional application No. 61/074,129, filed on Jun. 19, 2008.

(51) Int. Cl.
*A47B 83/02* (2006.01)
*A47D 1/00* (2006.01)
*A47D 1/10* (2006.01)

(52) U.S. Cl. ..... 297/148; 297/256.16; 297/134

(58) Field of Classification Search ..... 297/16.1, 297/19, 21, 24, 130, 134, 148, 149
See application file for complete search history.

(56) References Cited

U.S. PATENT DOCUMENTS

| | | | | |
|---|---|---|---|---|
| 3,319,997 | A | 5/1967 | Clement | |
| 4,291,915 | A | 9/1981 | Cox | |
| 5,562,330 | A | 10/1996 | Cabagnero | |
| 5,564,778 | A * | 10/1996 | Shimer et al. | 297/130 |
| 5,951,102 | A | 9/1999 | Poulson | |
| 6,033,019 | A | 3/2000 | Hession-Kunz | |
| 6,089,653 | A | 7/2000 | Hotaling | |
| 6,120,041 | A | 9/2000 | Gehr, Jr. et al. | |
| 6,237,996 | B1 | 5/2001 | Chen | |
| 6,390,345 | B1 | 5/2002 | Brown | |
| 6,719,371 | B2 | 4/2004 | Yoshie et al. | |
| 6,773,064 | B2 | 8/2004 | Treen | |
| 7,300,103 | B1 | 11/2007 | Grays | |
| 7,673,934 | B2 * | 3/2010 | Bearup et al. | 297/130 |
| 7,735,911 | B2 | 6/2010 | Chen | |
| 7,896,431 | B2 | 3/2011 | Cui | |
| 2002/0167214 | A1 | 11/2002 | Nelson | |
| 2006/0250005 | A1 | 11/2006 | Keegan | |
| 2008/0036256 | A1 | 2/2008 | Gold | |
| 2009/0250977 | A1 | 10/2009 | Hu | |
| 2010/0201164 | A1 | 8/2010 | Galley | |

FOREIGN PATENT DOCUMENTS

| | | | |
|---|---|---|---|
| DE | 1 002 513 | | 2/1957 |
| EP | 1 277 423 | A1 | 1/2003 |
| EP | 1 574 389 | A1 | 9/2005 |
| WO | 2006130906 | A1 | 12/2006 |

* cited by examiner

*Primary Examiner* — Sarah B McPartlin
(74) *Attorney, Agent, or Firm* — Winston Hsu; Scott Margo

(57) ABSTRACT

A child chair includes a seat and a frame. The seat is detachably mounted on the frame by using an engaging assembly. The engaging assembly includes an engaging device and a coupling device. The engaging device is movably mounted on the seat. The coupling device is mounted on the frame and coupled with the engaging device on the seat. The engaging device is cooperated with the coupling device between a locking position and a release position relative to the seat.

10 Claims, 19 Drawing Sheets

CHILD CHAIR HAVING ENGAGING ASSEMBLY FOR SEAT

CROSS REFERENCE TO RELATED APPLICATIONS

This is a divisional application of Ser. No. 12/486,729 (filed on Jun. 17, 2009), which claims the priority of U.S. Provisional Application No. 61/074,129 (filed on Jun. 19, 2008), No. 61/091,724 (filed on Aug. 25, 2008) and No. 61/140,973 (filed on Dec. 28, 2008). The whole content of the related application is incorporated herein by reference.

BACKGROUND OF THE INVENTION

1. Field of the Invention

The invention relates to a child chair and, more particularly, to a child chair having an engaging assembly for selectively fastening a seat on a frame. Furthermore, the seat can be detached from the frame by operating the engaging assembly and then be placed on common chair for the purpose of increasing height of seat.

2. Description of the Prior Art

At the present time, child chair has been commonly used for an infant or child. The child chair can keep the infant or child close to a dining table while dining, so that a parent or other care giver can take care of the infant or child conveniently. Though there are various child chairs in the market, most of seats can only be mounted on a frame of a specific child chair. If the shape or size of the frame cannot fit the dining table, it will be inconvenient for parent or care giver while using the child chair.

SUMMARY OF THE INVENTION

The invention provides a child chair comprising a seat and a frame. The seat is detachably mounted on the frame. The frame comprises a coupling device for being coupled with the seat. The child chair comprises an engaging device movably mounted on one side of the seat. The engaging device is cooperated with the coupling device between a locking position and a release position relative to the seat.

According to the child chair of the invention, the frame comprises a front leg and a rear leg. The front leg comprises an upper front leg and a lower front leg. The upper front leg is mounted on a top of the lower front leg. The rear leg is pivotally connected to one of the upper front leg and the lower front leg.

The child chair of the invention comprises an engaging assembly. According to a first embodiment, the engaging assembly comprises the engaging device, the coupling device and a driving device. The engaging device comprises a first protruding portion. The driving device is movably mounted on the seat and connected to the engaging device so as to drive the engaging device to move from the locking position to the release position. The coupling device comprises a recess and a first guiding track. The recess is connected to the first guiding track. The first protruding portion is movable in the recess and the first guiding track so as to enable the engaging device to move between the locking position and the release position.

According to a second embodiment and a third embodiment of the invention, the coupling device of the engaging assembly comprises a support tube mounted on the frame. The engaging device is pivotally connected to the seat so as to be selectively engaged with or disengaged from the support tube. The driving device is movably mounted on the seat and pivotally connected to the engaging device. The driving device is used for driving the engaging device to rotate with respect to the seat so as to disengage the engaging device from the support tube.

According to a fourth embodiment of the invention, the engaging assembly further comprises a base mounted on a bottom side of the seat. The base comprises a guiding groove, the seat comprises a guiding rib corresponding to the guiding groove, and the guiding rib is movably coupled with the guiding groove. When the engaging device is disengaged from the support tube, the guiding groove moves along the guiding rib so as to protrude the base from the seat.

According to the invention, the child chair utilizes an engaging assembly to alternatively couple the seat with the frame or detach the seat from the frame. When the seat is detached from the frame, the seat can be placed on a common chair so as to fit the size of dining table or satisfy requirements of care giver.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
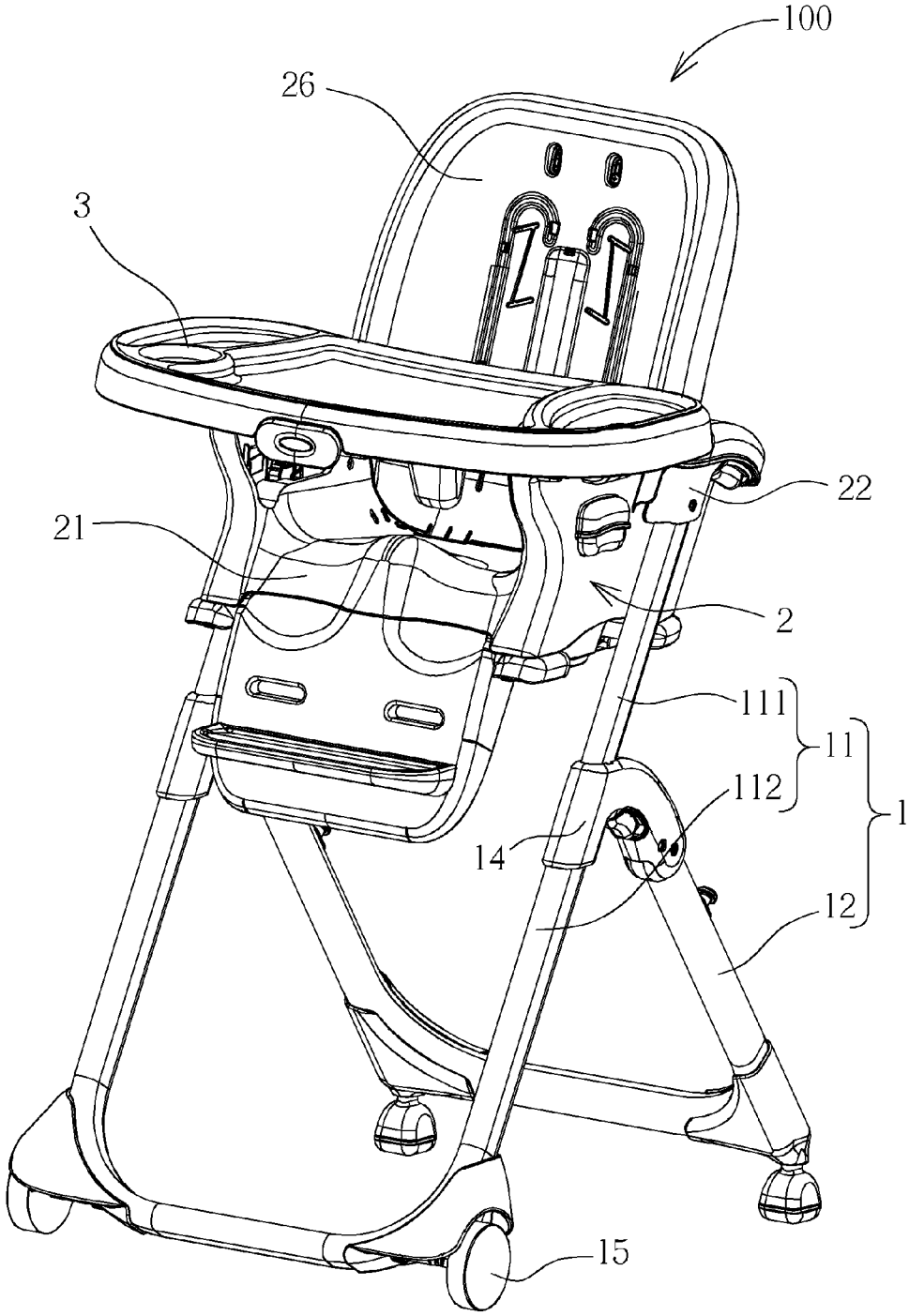
FIG. 1 is a perspective view illustrating a child chair of the invention.

Referring to FIG. 1, FIG. 1 is a perspective view illustrating a child chair 100 of the invention. The child chair 100 comprises a frame 1, a seat assembly 2 and a tray 3. The seat assembly 2 comprises a seat 21, an engaging assembly 22 and a backrest 26. The engaging assemblies 22 are mounted on both sides of the seat 21 respectively, so that the seat 21 is detachably mounted on the frame 1. The seat 21 can be easily detached from the frame 1 by operating the engaging assemblies 22. The tray 3 is disposed in the front of the seat assembly 2. The frame 1 comprises a front leg 11, a rear leg 12 and a connecting member 14. The front leg 11 and the rear leg 12 are respectively connected to the connecting member 14, such that the front leg 11 is pivotally connected to the rear leg 12 by the connecting members 14 mounted on both sides of the frame 1. The connecting member 14 is mounted on a middle portion of the front leg 11, and the rear leg 12 is therefore connected to the middle portion of the front leg 11. The front leg 11 comprises an upper front leg 111 and a lower front leg 112. The upper front leg 111 is adjustably mounted on a top of the lower front leg 112. Accordingly, the height of the seat assembly 2 can be adjusted by lengthening or shortening the upper front leg 111 with respect to the lower front leg 112. In this embodiment, since the connecting member 14 is mounted on the top of the lower front leg 112, the rear leg 12 is pivotally connected to the lower front leg 112. However, in another embodiment, the rear leg 12 also can be pivotally connected to the upper front leg 111 of the front leg 11. Furthermore, a wheel mechanism 15 can be mounted on a lower end of at least one of the front leg 11 and the rear leg 12, such that the child chair 100 can be easily moved by a user.

Figure 2:
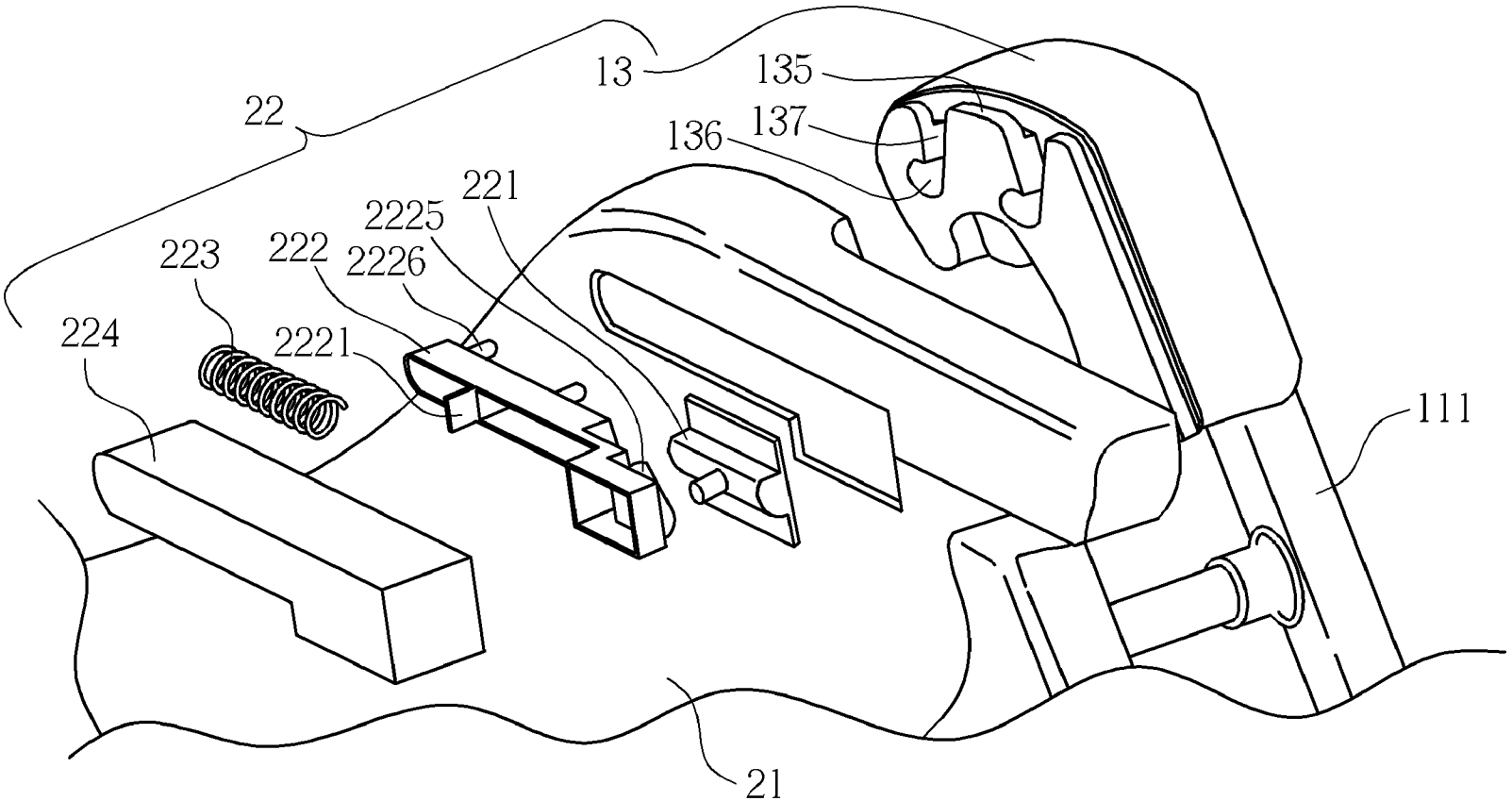
FIG. 2 is an exploded view illustrating the engaging assembly according to a first embodiment.

Referring to FIG. 2, FIG. 2 is an exploded view illustrating the engaging assembly 22 according to a first embodiment. The engaging assembly 22 comprises a coupling device 13, a driving device 221, an engaging device 222, a first resilient member 223 and a casing 224. In this embodiment, the driving device 221 can be a button and the first resilient member 223 can be a spring. The coupling device 13 is mounted on a top of the front leg 11. The engaging device 222 is coupled with the coupling device 13 so as to fasten the seat 21 on the frame 1. Preferably in this embodiment, two engaging devices 222 are symmetrically mounted on both sides of the seat 21 and two coupling devices are also symmetrically mounted on the top of the front leg 11. The driving device 221 passes through the seat 21 from outside to inside. The engaging device 222 movably passes through the seat 21 from inside to outside. Both ends of the first resilient member 223 abut against the casing 224 and an abutting portion 2221 of the engaging device 222 respectively. The casing 224 covers the engaging device 222 and the first resilient member 223 and is fastened on the seat 21. The engaging device 222 is cooperated with the coupling device 13, the driving device 221 and the first resilient member 223 to keep the seat 21 at a locking state or a release state. The driving device 221 is movably mounted on the seat 21 and connected to the engaging device 222. The driving device 221 can drive the engaging device 222 to move from a locking position to a release position relative to the seat 21. On the other hand, the first resilient member 223 can drive the engaging device 222 to move from the release position to the locking position relative to the seat 21. Accordingly, the seat 21 can be detached from or attached to the frame 1.

Figure 3:
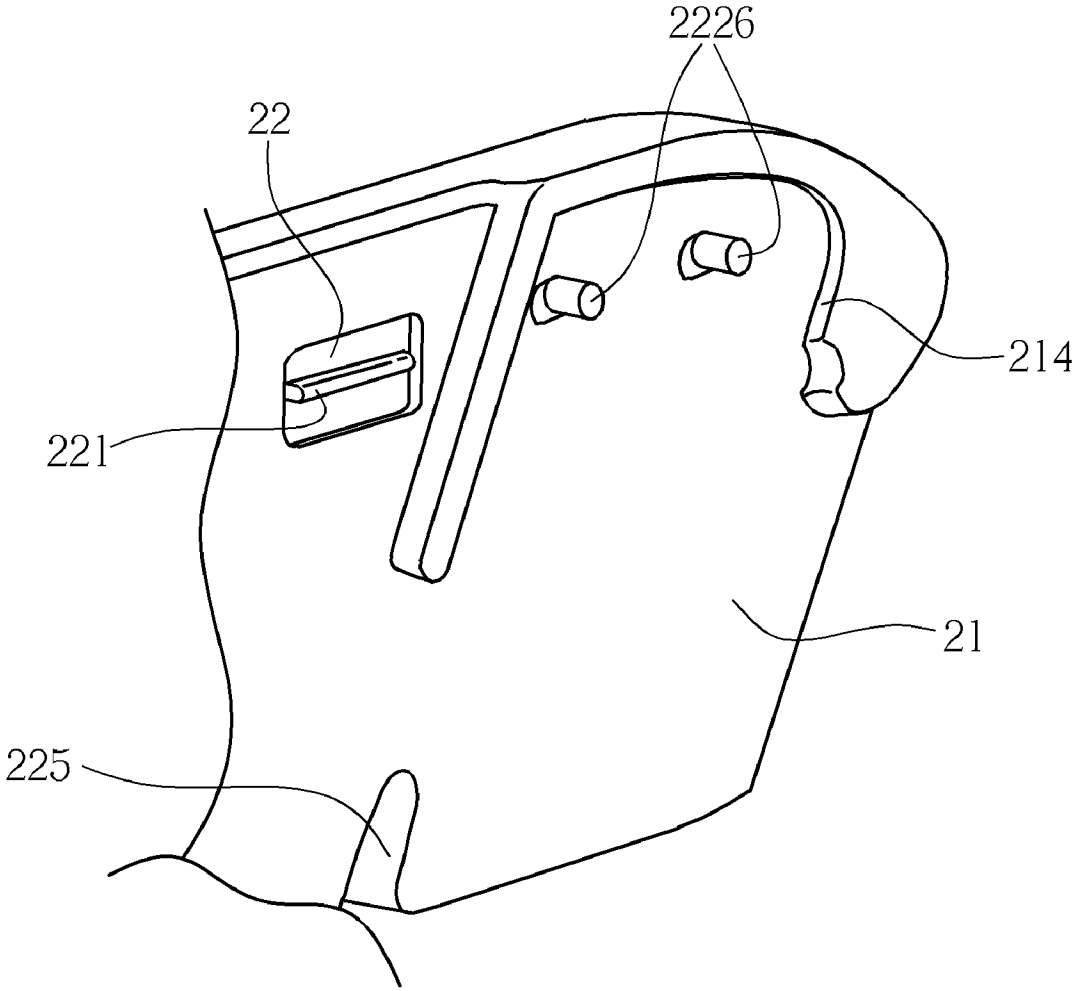
FIG. 3 is an outside view illustrating one side of the engaging assembly and the seat according to a first embodiment.
Figure 4:
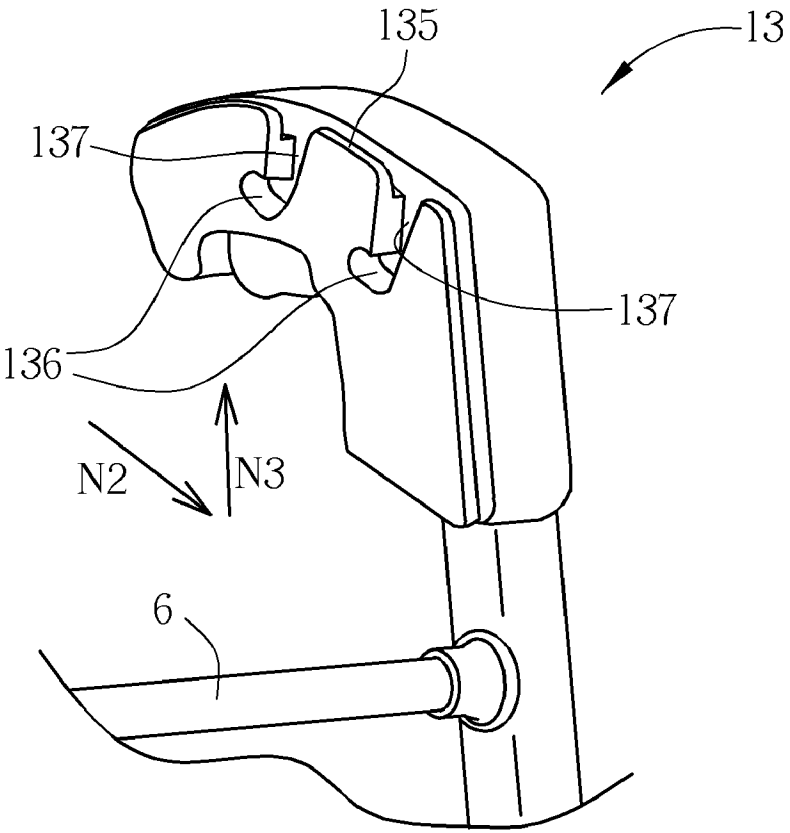
FIG. 4 is a schematic diagram illustrating the coupling device of the engaging assembly according to the first embodiment.
Figure 5:
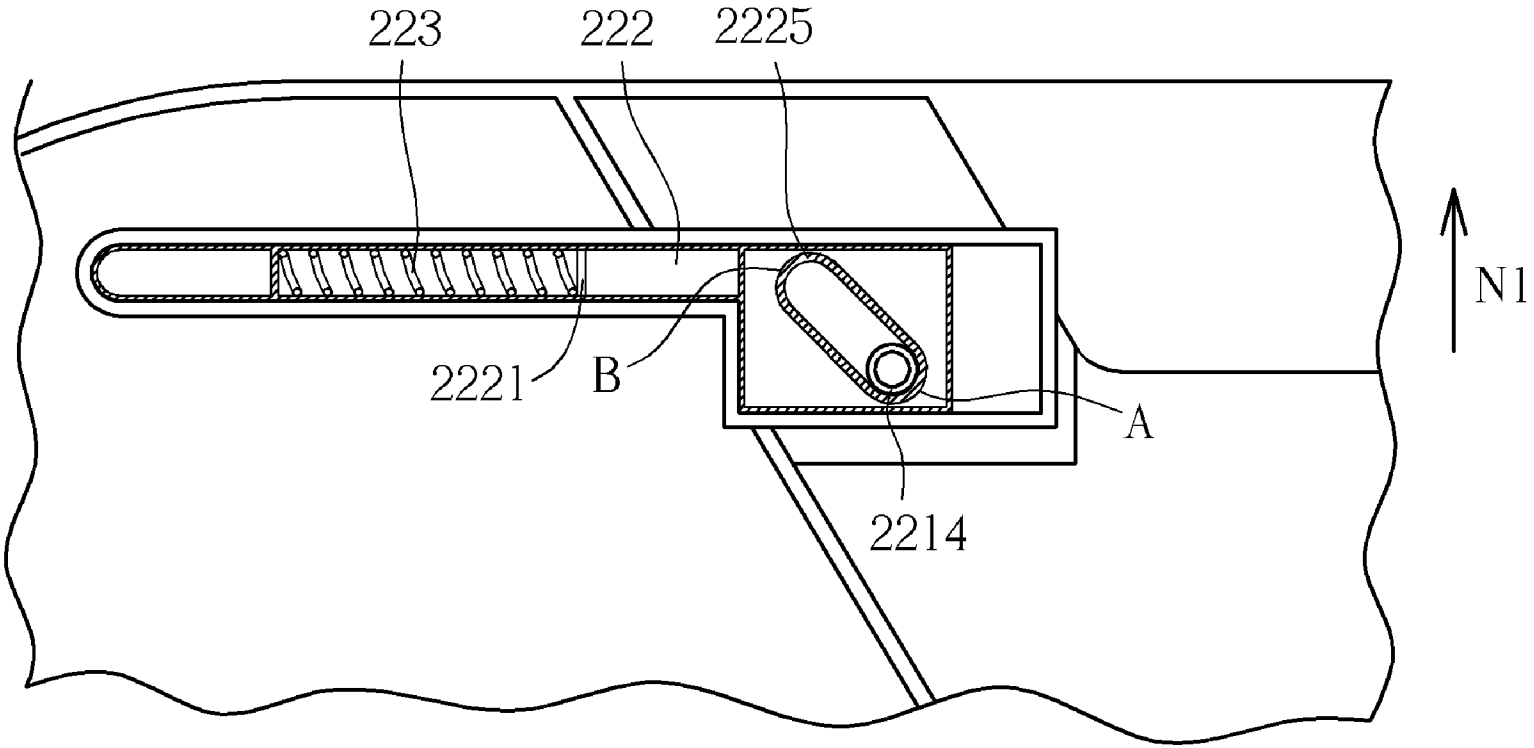
FIG. 5 is a schematic diagram illustrating the engaging device of the engaging assembly located at the locking position.
Figure 6:
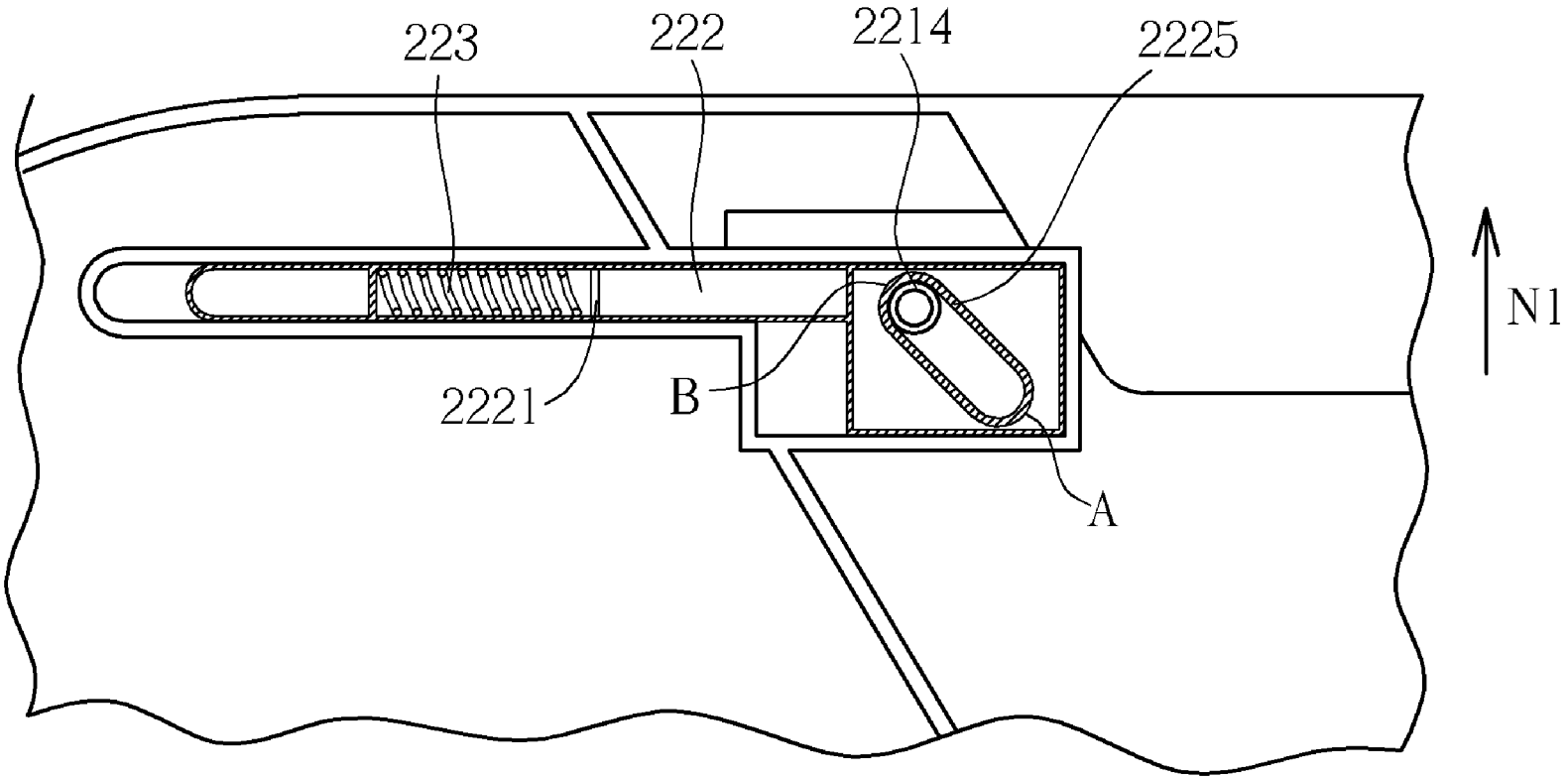
FIG. 6 is a schematic diagram illustrating the engaging device of the engaging assembly located at the release position.

Referring to FIGS. 3 to 6 along with FIG. 2, FIG. 3 is an outside view illustrating one side of the engaging assembly 22 and the seat 21, FIG. 4 is a schematic diagram illustrating the coupling device 13 of the engaging assembly 22 according to the first embodiment, FIG. 5 is a schematic diagram illustrating the engaging device 222 of the engaging assembly 22 located at the locking position, and FIG. 6 is a schematic diagram illustrating the engaging device 222 of the engaging assembly 22 located at the release position. As shown in FIG. 4, the coupling device 13 of the first embodiment comprises a recess 136 and a first guiding track 137. The recess 136 is formed along a second direction N2, adjacent to the first guiding track 137 and communicated with the first guiding track 137. The recess 136, which is along the second direction N2, cooperates with the first guiding track 137, which is along a third direction N3, to form an L-shaped groove. As shown in FIGS. 2 and 5, the engaging device 222 comprises two first protruding portions 2226 and a second guiding track 2225. The protruding portions 2226 pass through the seat 21 from inside to outside and are movable in the L-shaped groove formed by the recess 136 and the first guiding track 137, such that the protruding portion 2226 can be engaged with the recess 136 (the engaging device 222 is located at the locking position at this moment) or the protruding portion 2226 can move away from the first guiding track 137 (the engaging device 222 is located at the release position at this moment). As shown in FIGS. 5 and 6, the second guiding track 2225 is oblique and has a first abutting position A and a second abutting position B along a first direction N1. In this embodiment, the second abutting position B is closer to the first protruding portion 2226 of the engaging device 222 than the first abutting position A. The driving device 221 comprises a second protruding portion 2214. The second protruding portion 2214 passes through the seat 21 from outside to inside and extends to the second guiding track 2225. As shown in FIG. 5 along with FIGS. 3 and 4, the seat 21 is situated at the locking state, the first protruding portion 2226 is located in the recess 136, the second protruding portion 2214 is located at the first abutting position A, and the engaging device 222 is located at the locking position. At this moment, the seat 21 is engaged with the frame 1. As shown in FIG. 6, to detach the seat 21 from the frame 1, the driving device 221 may be pulled along the first direction N1 (i.e. release direction) so as to move the second protruding portion 2214 from the first abutting position A to the second abutting position B in the second guiding track 2225. Afterward, the second protruding portion 2214 drives the engaging device 222 to move from the locking position (as shown in FIG. 5) to the release position (as shown in FIG. 6). At the same time, the first resilient member 223 is compressed between the casing 224 and the engaging device 222 so as to generate a bias force. As shown in FIG. 4, since the engaging device 222 is driven by the driving device 221, the first protruding portion 2226 of the engaging device 222 moves from the locking position in the recess 136 to the release position in the first guiding track 137 along the second direction N2. Consequently, the seat 21 can be detached from the frame 1 along the first guiding track 137.

When the engaging device 222 is located at the release position and the driving device 221 is released, the bias force generated by the first resilient member 223 will drive the engaging device 222 to move from the release position to the locking position. Therefore, when the seat 21 is attached to a support tube 6 of the frame 1 via an engaging groove 225 again, the first protruding portion 2226 of the engaging device 222 moves along the first guiding track 137 to the side of the recess 136, and then the first resilient member 223 forces the first protruding portion 2226 of the engaging device 222 into the recess 136. Consequently, the first protruding portion 2226 of the engaging device 222 is engaged with the recess 136 again and the seat 21 is fastened on the frame 1.

As shown in FIGS. 3 and 4, the coupling device 13 comprises a guiding rib 135 and the seat 21 comprises a guiding groove 214 corresponding to the guiding rib 135. When the seat 21 is detached from the frame 1, the rib 135 may cooperate with the guiding groove 214, such that the seat 21 can be detached from the frame 1 along a predetermined direction. It should be noted that though the second guiding track 2225 of this embodiment is oblique, the shape of the second guiding track 2225 of the invention is not limited to any specific shape. That is to say, the features of the invention are to drive the engaging device 222 to move along the second direction N2 and to move the engaging device 222 from the locking position to the release position, so as to make the first protruding portion 2226 away from the recess 136.

Figure 7:
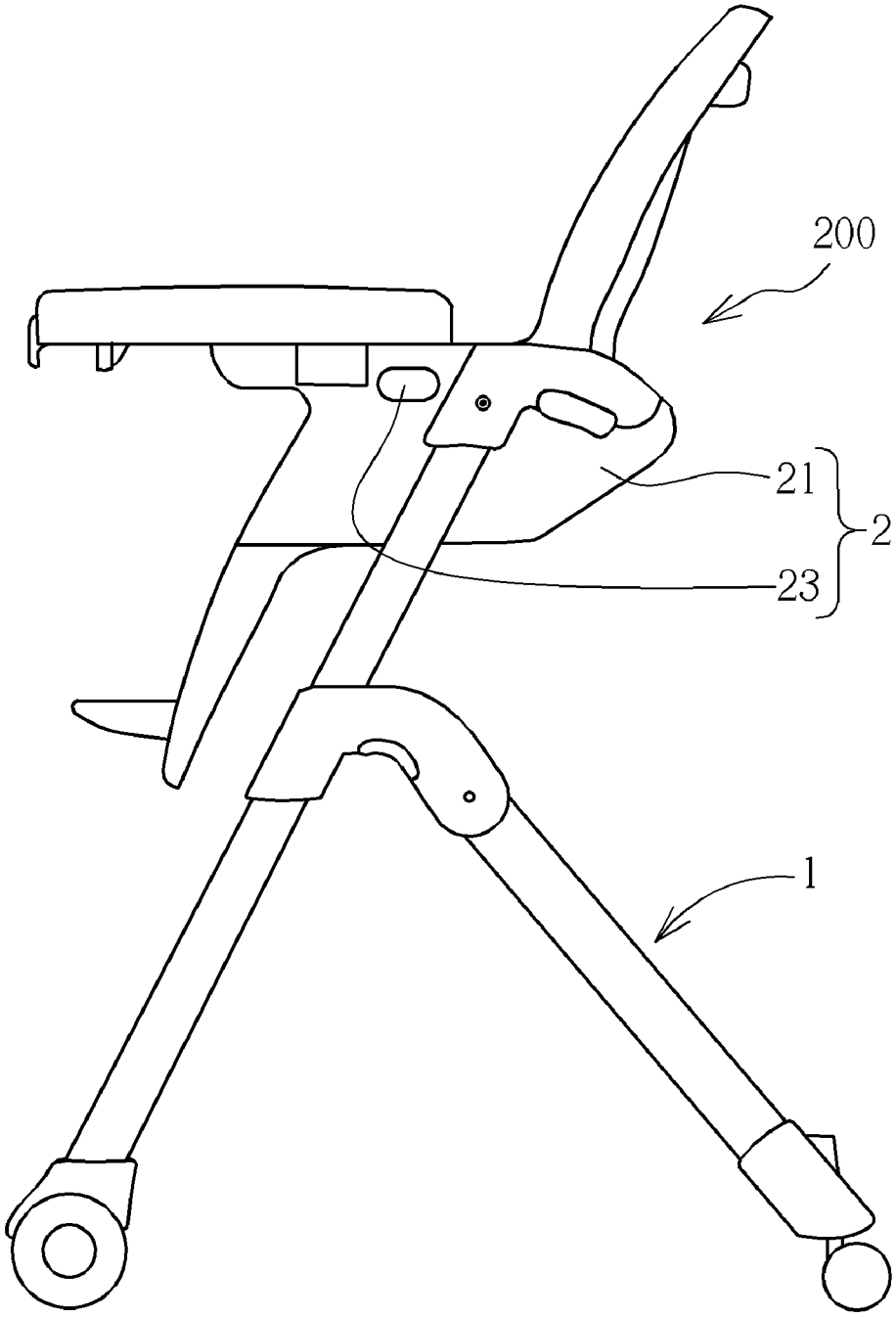
FIG. 7 is a side view illustrating a child chair.
Figure 8:
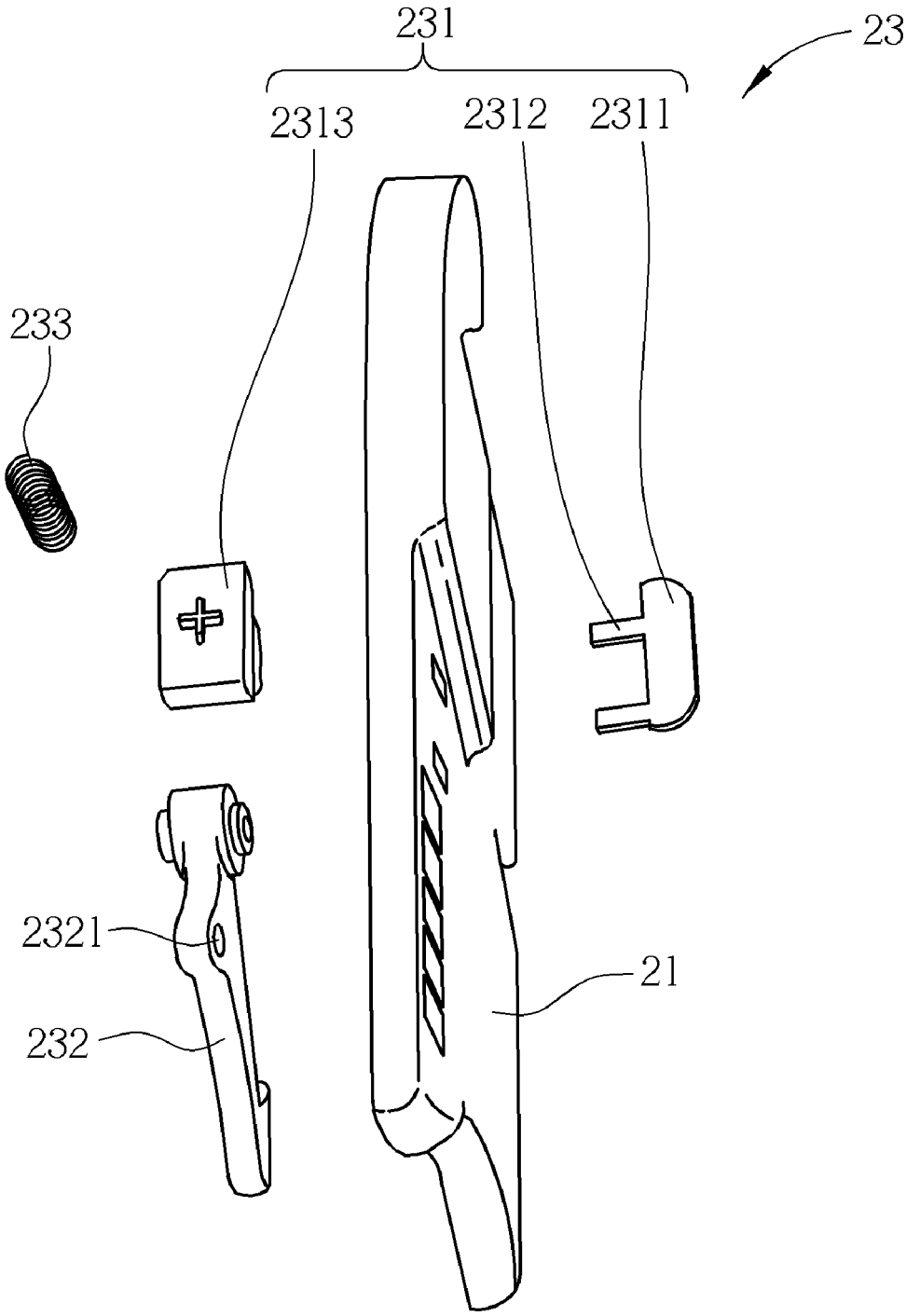
FIG. 8 is an exploded view illustrating parts of an engaging assembly according to a second embodiment.

Referring to FIGS. 7 and 8, FIG. 7 is a side view illustrating a child chair 200, and FIG. 8 is an exploded view illustrating parts of an engaging assembly 23 according to a second embodiment. The child chair 200 comprises a frame 1 and a seat assembly 2. The seat assembly 2 comprises a seat 21 and an engaging assembly 23. The main difference between the first and second embodiments is that the engaging assembly 23 can be implemented in different manners. In this embodiment, the engaging devices of the engaging assembly 23 are mounted on both sides of the seat 21. The coupling device is mounted on the frame 1 and below the seat 21 and have a support tube 6 (shown in FIG. 9).

The engaging assembly 23 comprises a driving device 231, an engaging device 232, a support tube 6 and a first resilient member 233. The first resilient member 233 can be a spring. The engaging device 232 is pivotally connected to the seat 21 and capable of rotating with respect to the seat 21 so as to be engaged with or disengaged from the support tube 6. In this embodiment, the driving device 231 comprises a button 2311 and a connecting member 2313. The button 2311 is movably mounted on the seat 21 from outside to inside and connected to the connecting member 2313. The connecting member 2313 is pivotally connected to the engaging device 232. Both ends of the first resilient member 233 are respectively connected to a protrusion 216 of the seat 21 and the connecting member 2313 of the driving device 231. The engaging assembly 23 can be cooperated with the support tube 6 to keep the seat 21 at a locking state or a release state. That is to say, the engaging device 232 can be cooperated with the driving device 231 and the first resilient member 233, such that the driving device 231 can drive the engaging device 232 to rotate with respect to the seat 21 so as to disengage the engaging device 232 from the support tube 6. In other words, the engaging device 232 can be driven by the driving device 231 to rotate from a locking position to a release position or be driven by the first resilient member 233 to move from the release position to the locking position. Accordingly, the seat 21 can be alternatively detached from or attached to the frame 1.

Figure 9:
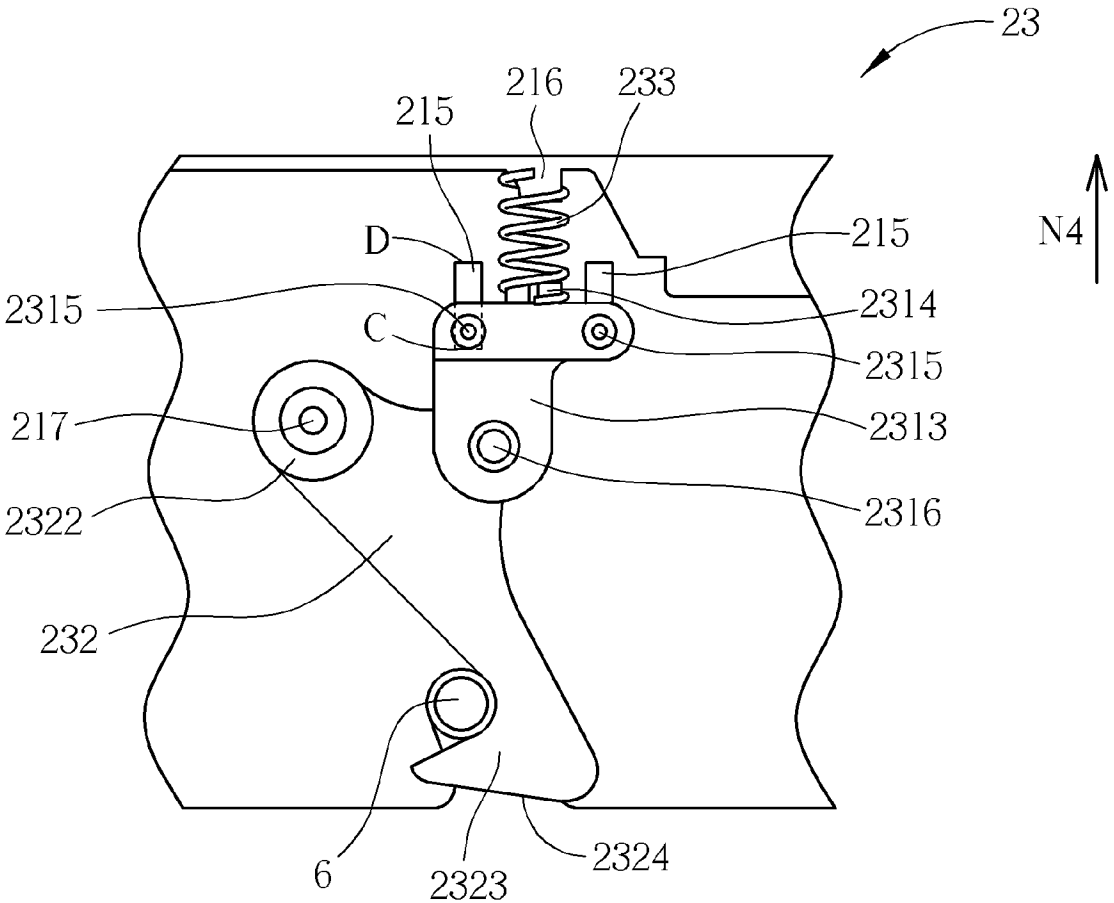
FIG. 9 is a schematic diagram illustrating the engaging assembly located at the locking position.
Figure 10:
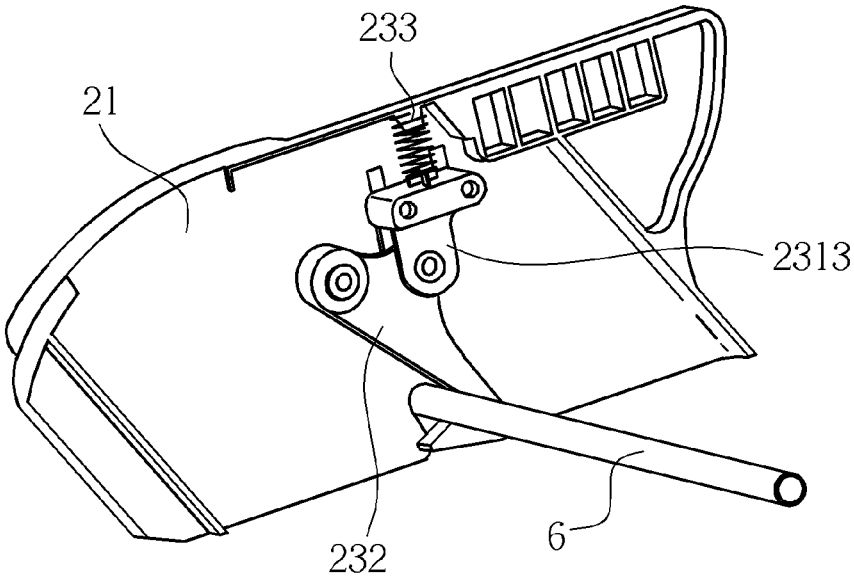
FIG. 10 is a schematic diagram illustrating the engaging device engaged with the support tube at the locking position.
Figure 11:
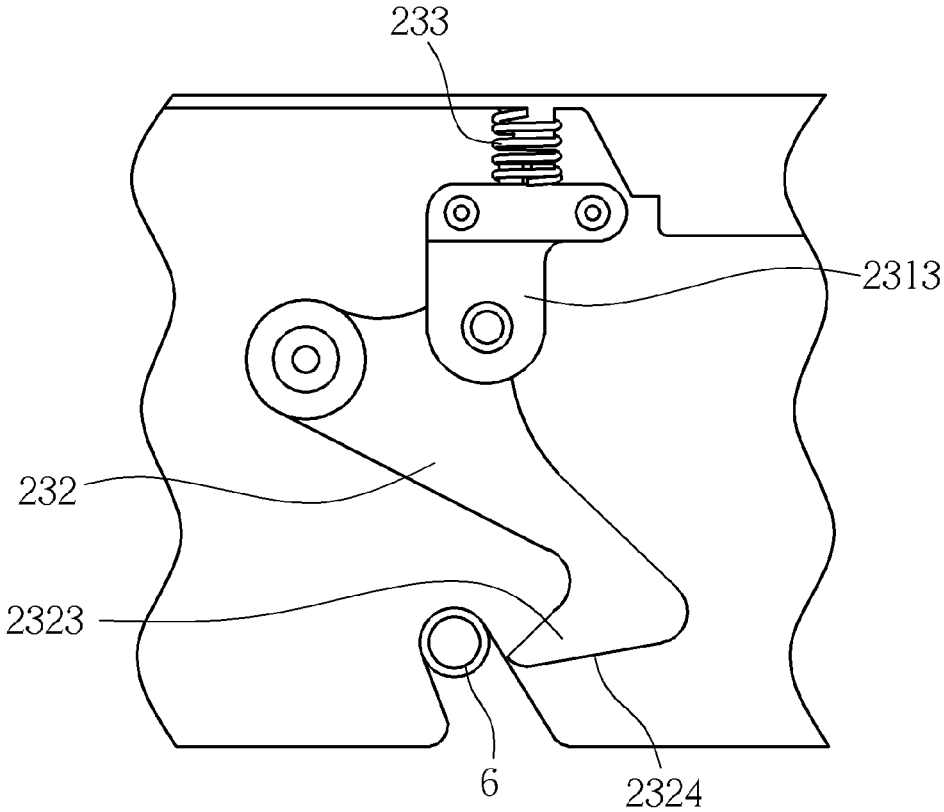
FIG. 11 is a schematic diagram illustrating the engaging assembly located at the release position.

Referring to FIGS. 9 to 11 along with FIG. 8, FIG. 9 is a schematic diagram illustrating the engaging assembly 23 located at the locking position, FIG. 10 is a schematic diagram illustrating the engaging device 232 engaged with the support tube 6 at the locking position, and FIG. 11 is a schematic diagram illustrating the engaging assembly 23 located at the release position. As shown in FIGS. 8 and 9, the seat 21 comprises two slots 215 and a protrusion 216, the button 2311 comprises two screw pillars 2312, the engaging device 232 comprises a hook 2323, a first hole 2321 and a second hole 2322, and the connecting member 2313 comprises a cross rib 2314, two first holes 2315 and a second hole 2316. Both ends of the first resilient member 233 are respectively connected to the protrusion 216 and the cross rib 2314. The screw pillars 2312 movably pass through the slots 215 and are fastened to the first holes 2315 of the connecting member 2313. The second hole 2316 of the connecting member 2313 is pivotally connected to the first hole 2321 (shown in FIG. 8) of the engaging device 232. The second hole 2322 is pivotally connected to the seat 21 by a pivot 217, such that the engaging device 232 can rotate on the pivot 217.

As shown in FIGS. 9 and 10, the slots 215 has a first abutting position C and a second abutting position D along a fourth direction N4. When the engaging device 232 is located at the locking position as shown in FIG. 9, the hook 2323 of the engaging device 232 hooks the support tube 6 so as to engage the seat 21 with the frame 1. At this moment, the button 2311 is located at the first abutting position C. As shown in FIG. 11, when a user wants to detach the seat 21 from the frame 1, he or she has to pull the button 2311 along a fourth direction N4 so as to drive the button 2311 to move from the first abutting position C to the second abutting position D along the fourth direction N4 in the slots 215. At the same time, the button 2311 drives the connecting member 2313 to move upwardly along the fourth direction N4 and drives the engaging device 232 to rotate on the pivot 217. The first resilient member 233 is compressed. When the engaging device 232 rotates to the release position, the hook 2323 is away from the support tube 6. As shown in FIG. 11, the seat can be detached from the frame 1.

After releasing the button 2311, the compressed first resilient member 233 will drive the connecting member 2313 and the engaging device 232 back to the position shown in FIG. 9, but the seat 21 has been detached from the frame 1 at this moment. When the user wants to attach the seat 21 to the frame 1 again, he or she has to pull the button 2311 along the fourth direction N4 and then the engaging device 232 is driven by the connecting member 2313 back to the release position. Furthermore, a bottom side of the hook 2323, which is opposite to a bottom surface of the seat 21, has an incline surface 2324. That is to say, there is an incline between the hook 2323 and an external force for pushing the seat 21 downwardly. To attach the seat 21 to the frame 1, the seat 21 may be pushed down directly. Afterwards, the support tube 6 abuts against the incline surface 2324 of the hook 2323, such that a component of the external force will drive the engaging device 232 to rotate. Therefore, the user can attach the seat 21 to the frame 1 directly without pressing the button 2311.

After fastening the seat 21 to the frame 1, the driving device 231 is released and a bias force generated by the first resilient member 233 drives the engaging device 232 to rotate from the release position to the locking position. Consequently, the hook 2323 is engaged with the support tube 6 and the seat 21 is fastened on the frame 1.

Figure 12:
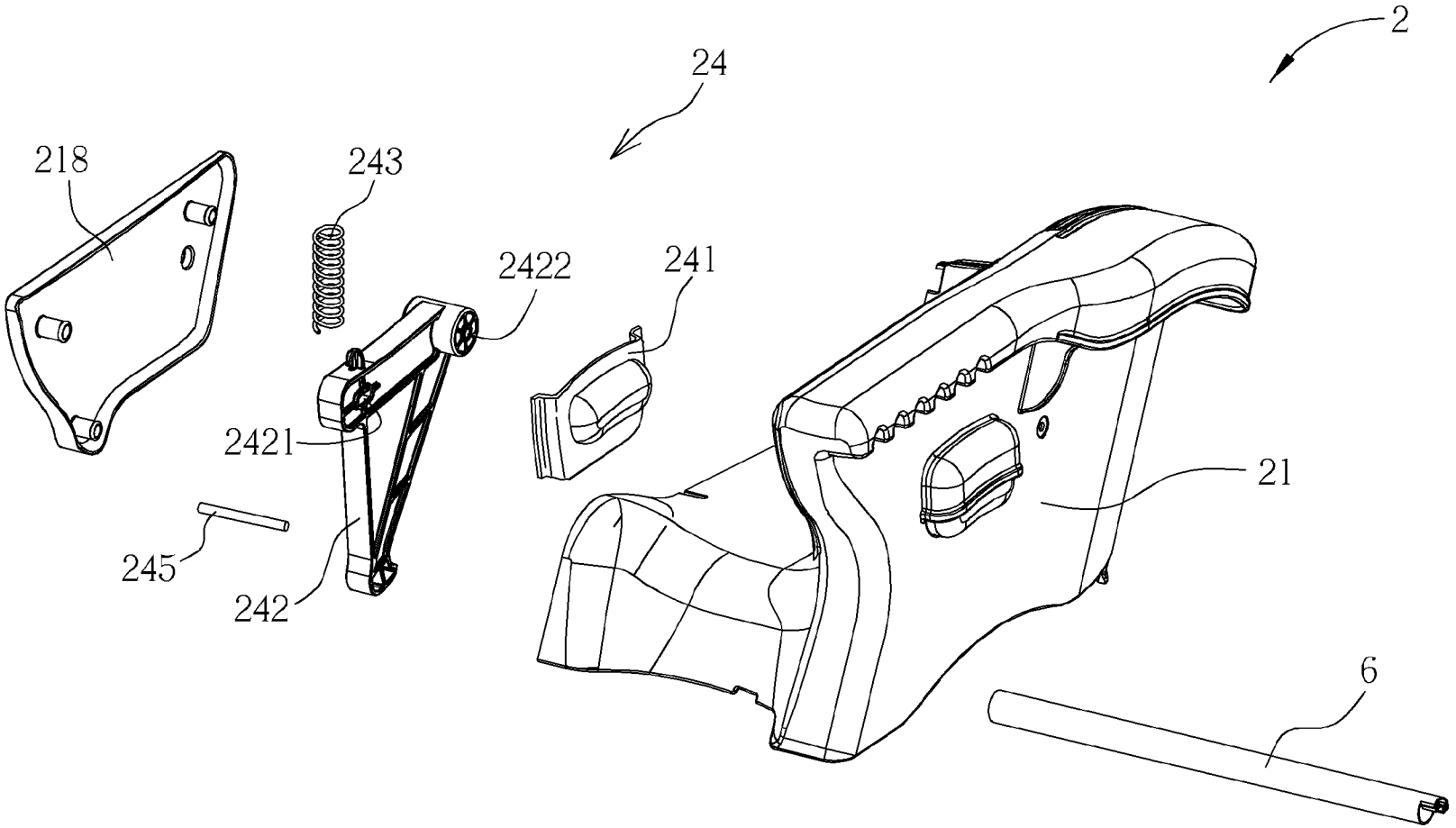
FIG. 12 is an exploded view illustrating an engaging assembly according to a third embodiment.

Referring to FIG. 12, FIG. 12 is an exploded view illustrating an engaging assembly 24 according to a third embodiment. As shown in FIG. 12, the seat 21 further comprises a cover 218. The engaging assembly 24 is mounted on the cover 218 and comprises a driving device 241, an engaging device 242, a support tube 6 and a first resilient member 243. In this embodiment, the driving device 241 is a button and the first resilient member 243 is a spring. The driving device 241 movably passes through the seat 21 from outside to inside. The engaging device 242 is pivotally connected to the cover 218 and the driving device 241, such that the engaging device 242 can be engaged with or disengaged from the support tube 6. Both ends of the first resilient member 243 are respectively connected to the cover 218 and the engaging device 242. The engaging device 242 can move between a release position and a locking position by operating the driving device 241 and the bias force generated by the first resilient member 243. Accordingly, the seat 21 can be alternatively detached from or attached to the frame 1.

Figure 13:
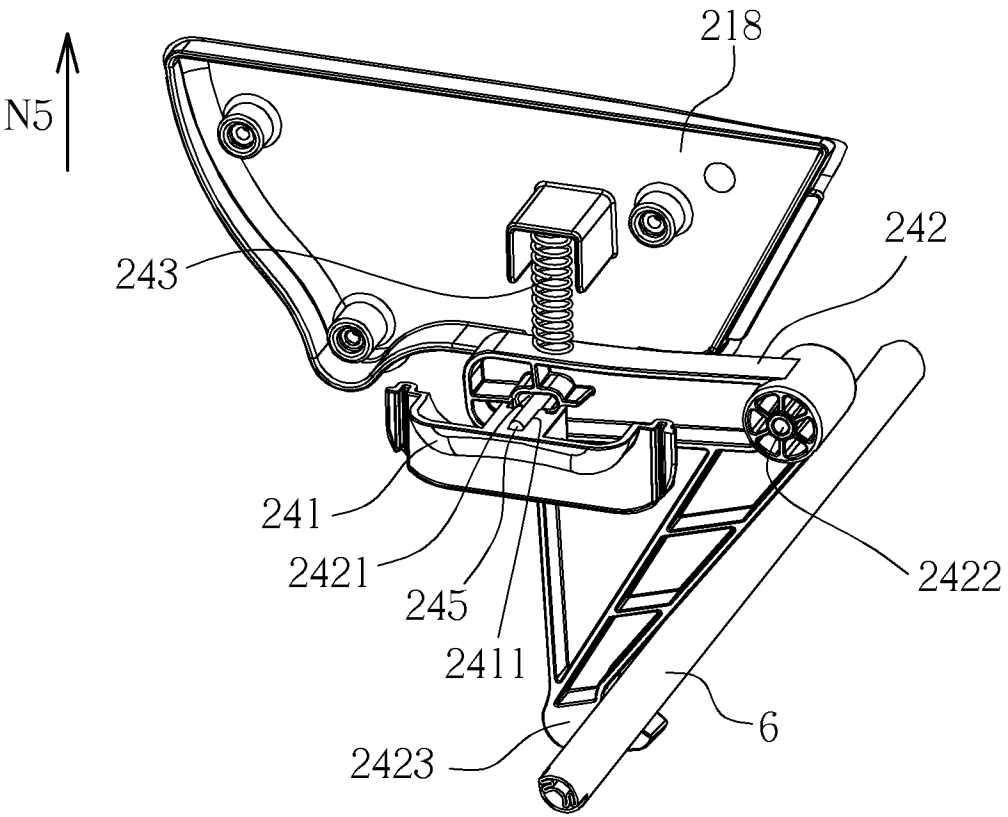
FIG. 13 is a schematic diagram illustrating the engaging assembly located at a locking position.
Figure 14:
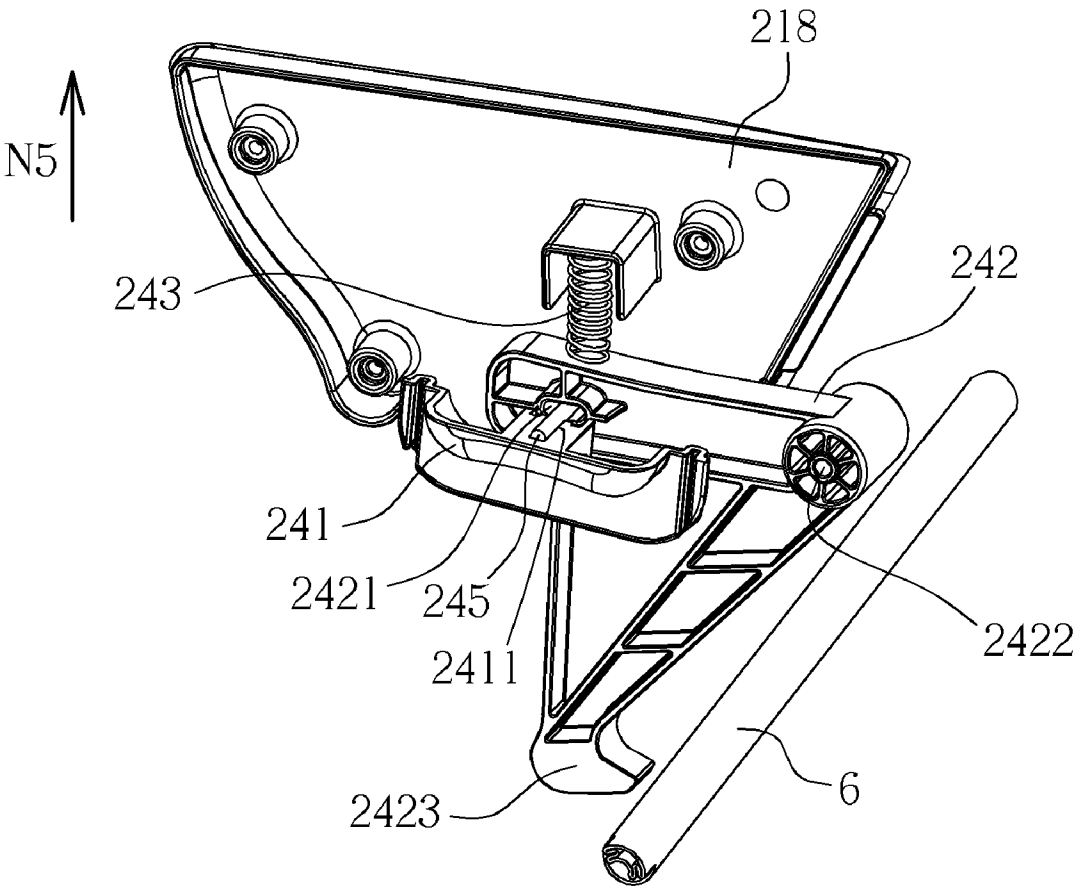
FIG. 14 is a schematic diagram illustrating the engaging assembly located at a release position.
Figure 15:
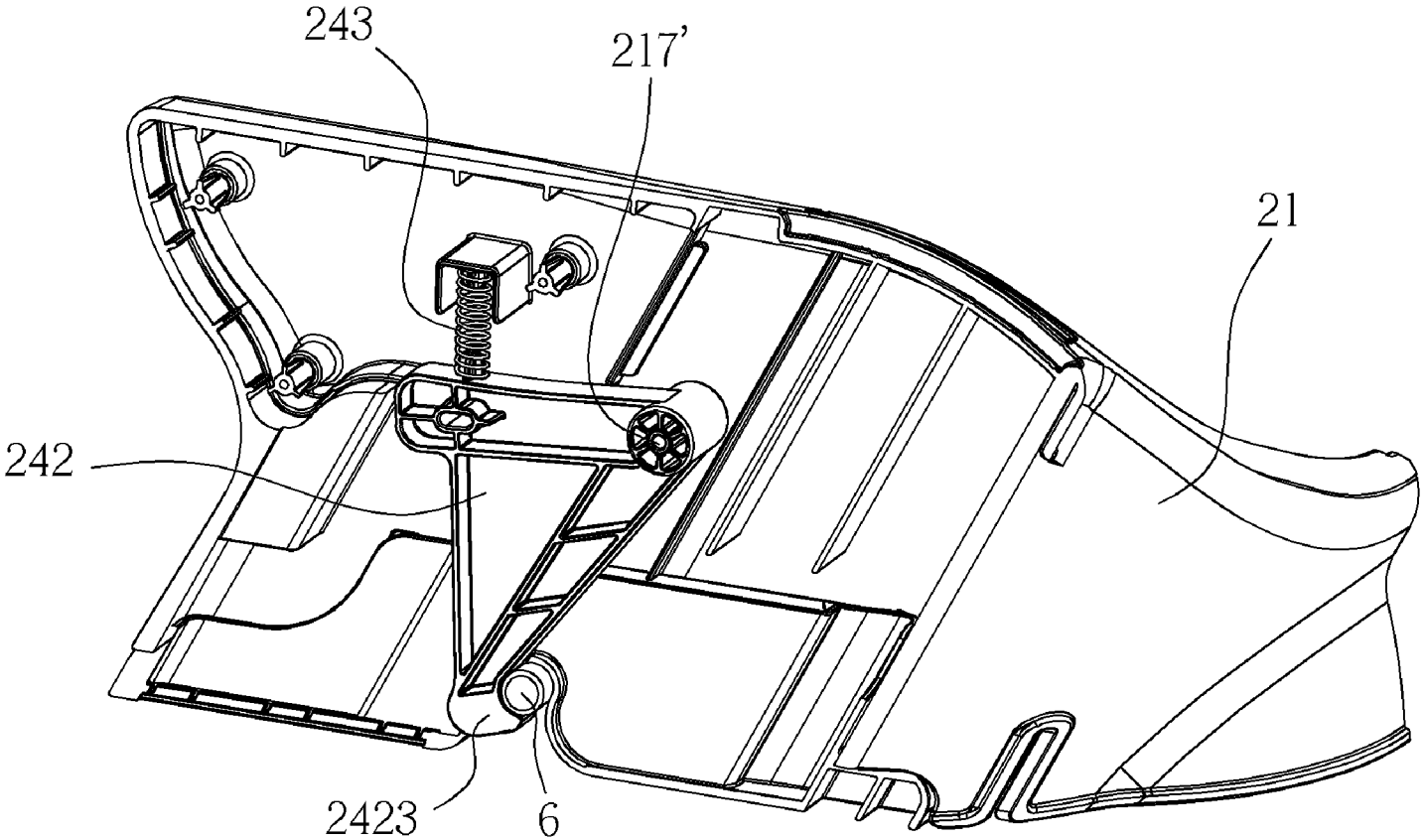
FIG. 15 is a side view illustrating the engaging assembly located at the locking position.
Figure 16:
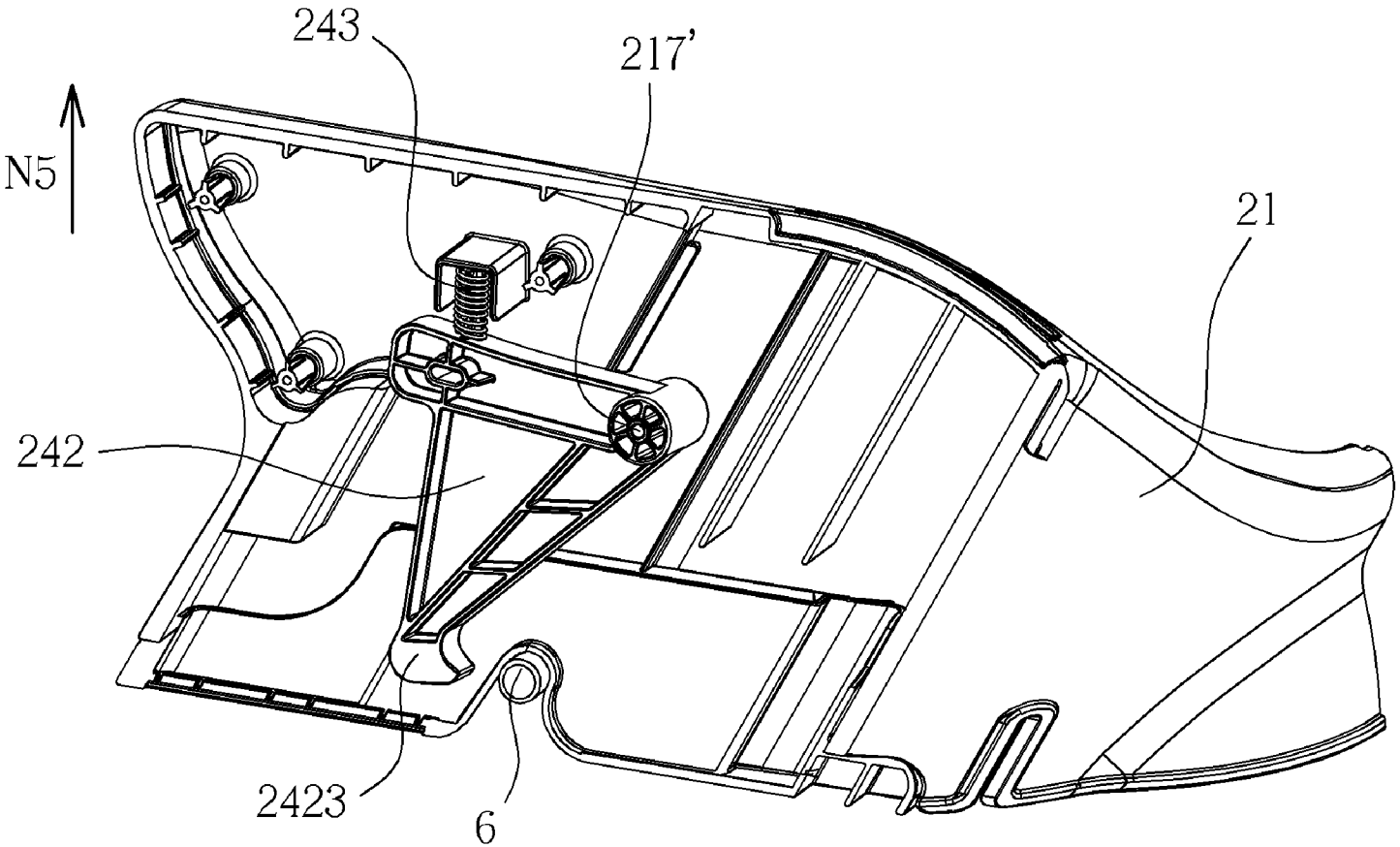
FIG. 16 is a side view illustrating the engaging assembly located at the release position.

Referring to FIGS. 13 to 16, FIG. 13 is a schematic diagram illustrating the engaging assembly 24 located at a locking position, FIG. 14 is a schematic diagram illustrating the engaging assembly 24 located at a release position, FIG. 15 is a side view illustrating the engaging assembly 24 located at the locking position, and FIG. 16 is a side view illustrating the engaging assembly 24 located at the release position. As shown in FIGS. 12, 13 and 15, the engaging device 242 comprises a hook 2423, a first hole 2421 and a second hole 2422, and the driving device 241 comprises an engaging groove 2411. The first hole 2421 of the engaging device 242 is pivotally connected to the engaging groove 2411 of the driving device 241 by a pin 245. The second hole 2422 is pivotally connected to the seat 21 by a pivot 217', such that the engaging device 242 can rotate on the pivot 217'. As shown in FIGS. 13 and 15, when the engaging device 242 is located at the locking position, the hook 2423 of the engaging device 242 hooks the support tube 6 so as to engage the seat 21 with the frame 1.

As shown in FIGS. 14 and 16, when the driving device 241 is pulled upwardly along a fifth direction N5 (i.e. release direction), the engaging device 242 is driven by the driving device 241 to rotate with respect to the pivot 217'. The hook 2423 moves away from the support tube 6 and the engaging device is located at the release position. Accordingly, the seat 21 can be detached from the frame 1. Then, once the button 241 is released, the compressed first resilient member 243 will force the engaging device 242 back to the position shown in FIG. 13, but the seat has been detached from the frame 1. When the user wants to attach the seat 21 to the frame 1 again, he or she has to pull the driving device 241 upwardly along the fifth direction N5 and then the engaging device 242 will be located at the release position again. After placing the seat 21 on the frame 1 and releasing the button 241, a bias force generated by the first resilient member 243 will drive the engaging device 242 to rotate from the release position to the locking position. Then, the hook 2423 is engaged with the support tube 6 and the seat 21 is fastened on the frame 1.

Figure 17:
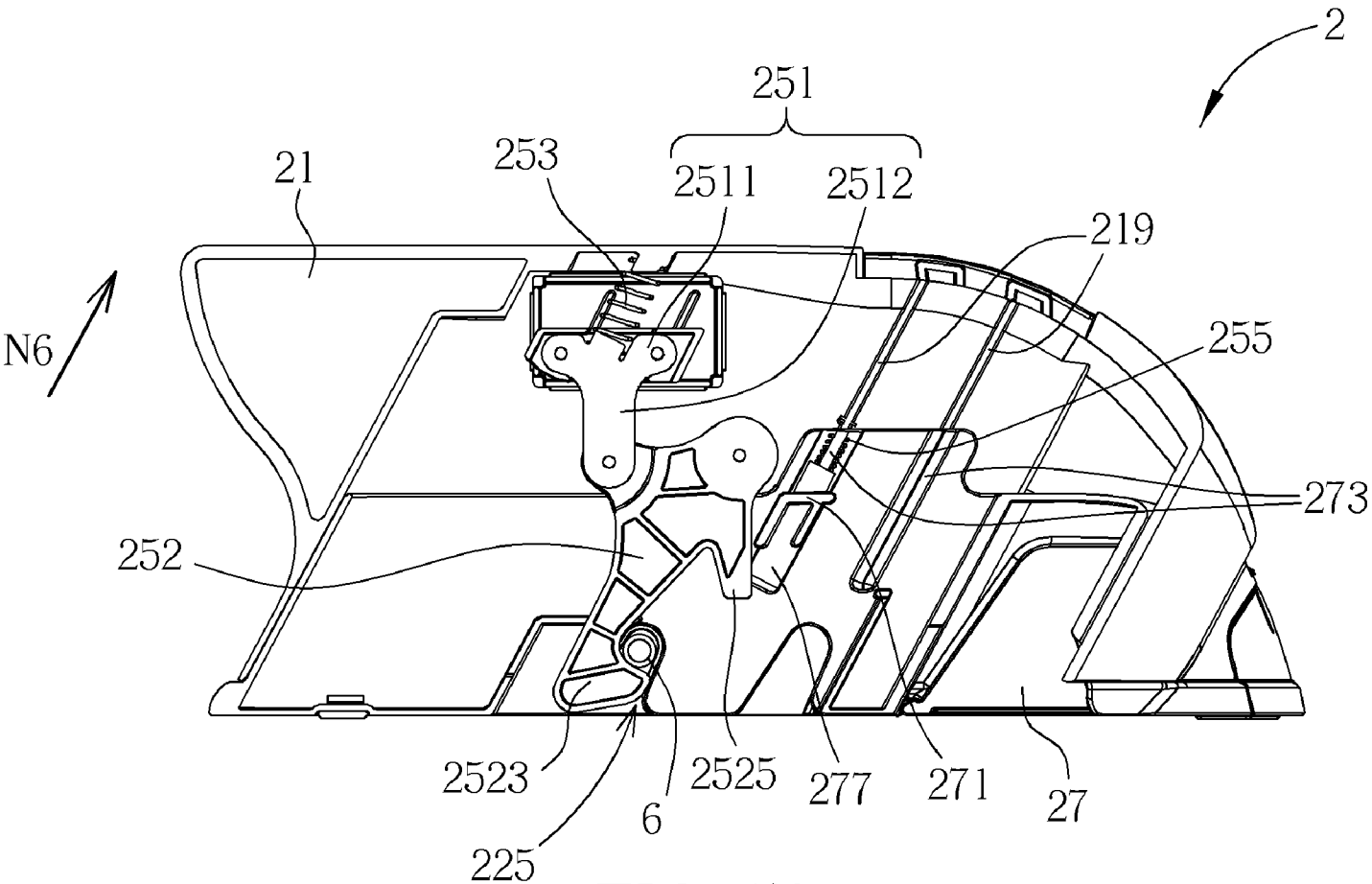
FIG. 17 is a schematic diagram illustrating an engaging assembly according to a fourth embodiment, wherein the engaging assembly is located at a locking position relative to a base.
Figure 18:
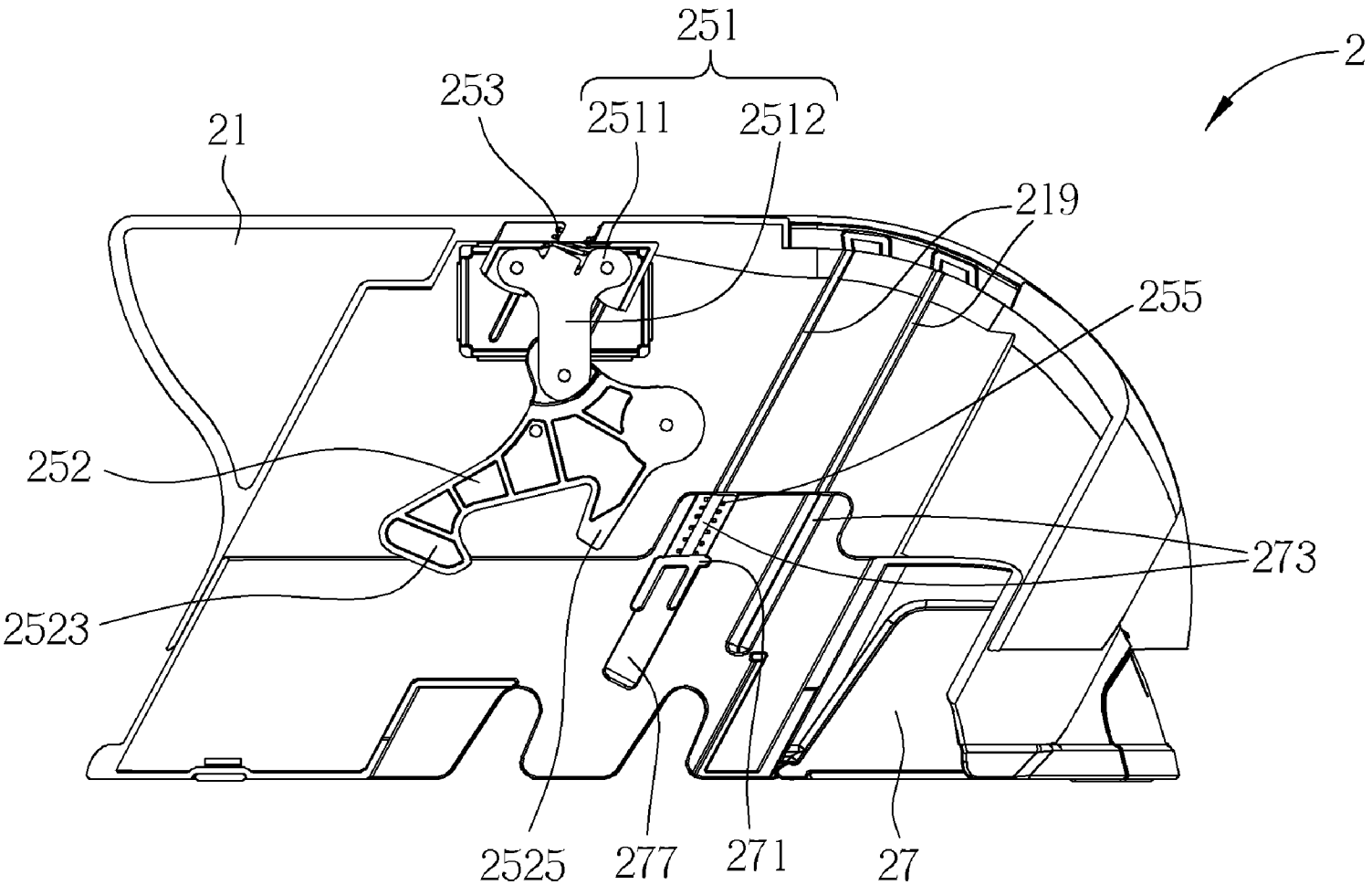
FIG. 18 is a schematic diagram illustrating the engaging device located at a release position and the base located at a protruding position.

Referring to FIGS. 17 and 18, FIG. 17 is a schematic diagram illustrating an engaging assembly 25 according to a fourth embodiment, wherein the engaging assembly 25 is located at a locking position relative to a base 27, and FIG. 18 is a schematic diagram illustrating the engaging device 25 located at a release position and the base 27 located at a protruding position. The engaging assembly 25 comprises a driving device 251, an engaging device 252, a support tube 6 and a first resilient member 253. The driving device 251 comprises a button 2511 and a connecting member 2512. The principle and function of each component of the engaging assembly 25 are the same as those of the engaging assembly 23 and are not described in detail here.

In this embodiment, the child chair 200 further comprises a base 27. The base is slidably mounted on the bottom side of the seat 21. The base 27 has a protruding position and a fastening position relative to the seat 21. When the seat 21 is fastened on the frame, the base 27 is located at the fastening position as shown in FIG. 17. The base 27 comprises a load bearing platform 271 and two guiding grooves 273. The seat 21 comprises two guiding ribs 219. The engaging device 252 comprises a block 2525. The engaging assembly 25 further comprises a second resilient member 255. The second resilient member 255 can be a spring. Both ends of the second resilient member 255 are respectively connected to a recess 277 of the base 27 and one end of the guiding rib 219. The guiding groove 273 of the base 27 can move along the guiding rib 219 of the seat 21 in a sixth direction N6, such that the base 27 can be alternatively protruded from or retracted into the seat 21 in the sixth direction N6. When the engaging device 252 is located at the locking position, the base 27 is retracted into the seat 21 and the second resilient member 255 is compressed. When the engaging device 252 is located at the release position, the hook 2523 is away from the support tube 6 and the block 2525 is away from the load bearing platform 271. Then, the second resilient member 255 generates a bias force for moving the guiding groove 273 of the base 27 along the guiding rib 219 in the sixth direction N6, so as to protrude the base 27 from the seat 21.

Figure 19:
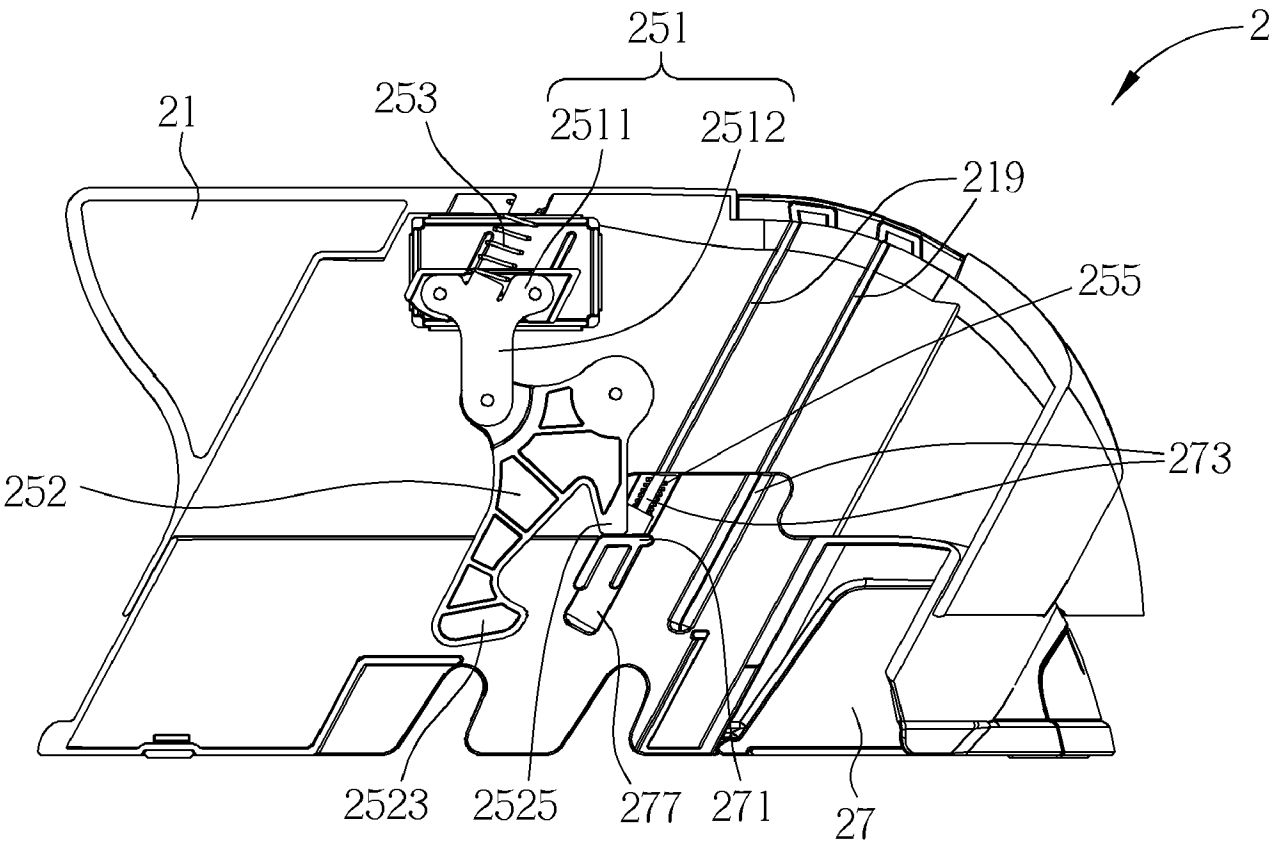
FIG. 19 is a schematic diagram illustrating the engaging device abutting against the base when the base is located at the protruding position.

As shown in FIG. 19, after releasing the hook 2523, the block 2525 abuts against the load bearing platform 271, such that the base 27 is kept at the protruding position relative to the seat 21. Accordingly, the seat assembly 2 can be placed on a common chair for the purpose of increasing height of seat. When the base 27 is located at the protruding position relative to the seat 21, the engaging groove 225 (shown in FIG. 17) of the seat 21 is blocked by the base 27. Therefore, the seat 21 cannot be coupled with the support tube 6 so as to prevent the seat 21 from being attached to the frame 1 while the base 27 is located at the protruding position. Accordingly, the dangerous due to mis-operation can be avoided. As shown in FIG. 19, since the block 2525 abuts against the load bearing platform 271, the base cannot be retracted into the seat 21 even if an infant or child is sitting on the seat 21. When the user wants to attach the seat 21 to the support tube 6, he or she has to press the button 241 to drive the engaging device 252 to move the block 2525 away from the load bearing platform 271. Then, the guiding groove 273 of the base 27 can move along the guiding rib 219 in the sixth direction N6 and the base 27 can be retracted into the seat 21. At this moment, the hook 2523 can be engaged with the support tube 6 again to fasten the seat 21.

Moreover, the support tube 6 disclosed in the aforesaid embodiments can also be implemented by a transverse support rod of the frame. Therefore, the engaging assembly just comprises the engaging device, the driving device, the resilient member, and so on. The engaging device can be engaged with the support rod of the frame directly so as to fasten the seat on the frame.

Figure 20:
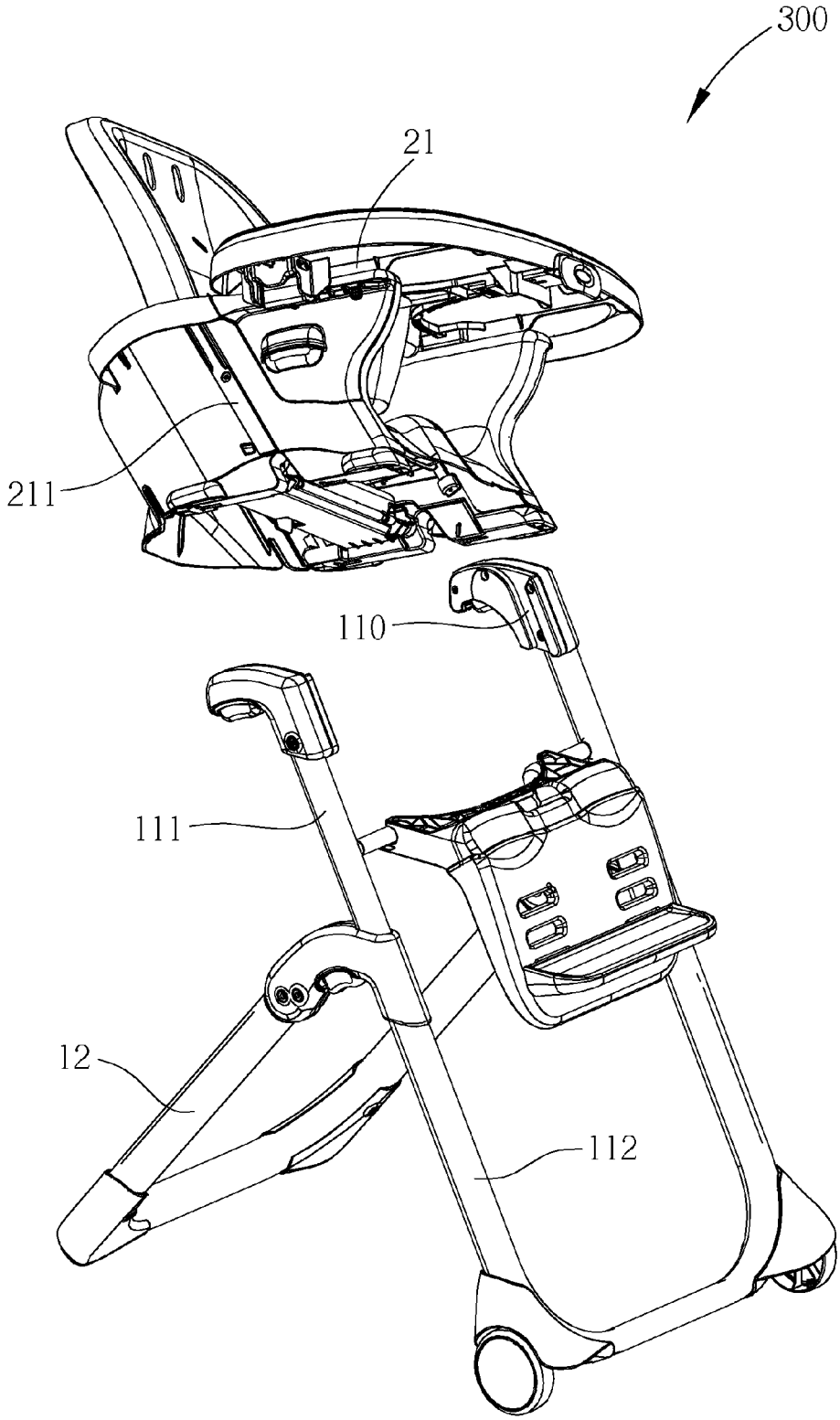
FIG. 20 is a schematic diagram illustrating a child chair according to a third embodiment of the invention.

Please refer to FIG. 20. In a child chair 300 according to another embodiment, two guiding tracks 211 respectively protrude from both sides of the seat 21 and two guiding grooves 110 are respectively formed on both sides of the upper front leg 111 of the frame 1. When attaching the seat 21 to the frame 1, the guiding tracks 211 of the seat 21 have to be aligned with the guiding grooves 110. Since the guiding tracks 211 are movable in the corresponding guiding grooves 110, the seat 21 can be attached to the frame 1 and fastened on the frame 1 by the aforesaid engaging assembly. Furthermore, this design can reduce the hazard of false engagement between the seat 21 and the frame 1. In case the seat 21 is not engaged well, the guiding tracks 211 accommodated in the guiding grooves 110 can prevent overturning of the seat 21.

The invention discloses a child chair having an engaging assembly. The child chair comprises a seat, a frame and the engaging assembly. The engaging assembly is mounted on both sides of the seat and the frame. A user can operate the engaging assembly to detach the seat from the frame easily and then place the seat on common chair. Furthermore, the engaging assembly comprises an engaging device of the seat coupled with a coupling device of the frame. When the engaging device is coupled with the coupling device, the engaging device is located at a locking position. When the driving device disengages the engaging device from the coupling device, the engaging device moves from the locking position to a release position, such that the seat can be detached from the frame.

Moreover, the engaging assembly can cooperate with a base below the seat so as to achieve more functions. When the engaging device is located at the locking position, the base is retracted into the seat. When the engaging device is located at the release position, the base protrudes from the seat, such that the seat can be placed on a common chair easily to achieve the purpose of increasing height of seat. It should be noted that the aforesaid first, fourth, fifth and sixth directions represent the directions while the driving (or button) drives the engaging device to move from the locking position to the release position, but the main feature of the invention is to move the engaging device to the release position and not limited to those embodiments mentioned in the above.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A child chair comprising:

a seat;

a frame, the seat being detachably mounted on the frame, the frame comprising:

a front leg comprising an upper front leg and a lower front leg, the upper front leg being mounted on a top of the lower front leg; and a rear leg pivotally connected to one of the upper front leg and the lower front leg; and an engaging assembly comprising:

an engaging device mounted on one side of the seat and movable between a locking position and a release position relative to the seat, the engaging device comprising a first protruding portion; and a coupling device mounted on the front leg and coupled with the engaging device on the seat so as to fasten the seat, the coupling device comprising a recess and a first guiding track, the recess being communicated with the first guiding track, and the first protruding portion being movable in the recess and the first guiding track so as to enable the engaging device to move between the locking position and the release position; and a driving device movably mounted on the seat and connected to the engaging device, the driving device being capable of driving the engaging device to move from the locking position to the release position.

2. The child chair of claim 1, wherein the driving device comprises a second protruding portion, the engaging device comprises a second guiding track, the second protruding portion extends to the second guiding track, and the second guiding track comprises a first abutting position and a second abutting position; when the engaging device is located at the locking position, the second protruding portion is located at the first abutting position; when the driving device moves along a release direction relative to the seat, the second protruding portion moves to the second abutting position in the second guiding track so as to drive the first protruding portion of the engaging device to move from the recess to the first guiding track.

3. The child chair of claim 2, wherein the second guiding track is oblique, and the second abutting position is closer to the first protruding portion than the first abutting position.

4. The child chair of claim 1, wherein the recess cooperates with the first guiding track to form an L-shaped groove.

5. The child chair of claim 1, wherein the driving device is a button.

6. The child chair of claim 1, wherein the engaging assembly further comprises a first resilient member disposed between the engaging device and the seat and used for generating a bias force so as to drive the engaging device to move from the release position to the locking position.

7. The child chair of claim 6, wherein the engaging assembly further comprises a casing, the first resilient member biases the engaging device and the casing, and the casing covers the engaging device and is fastened on the seat.

8. The child chair of claim 1, wherein the seat comprises a guiding groove corresponding to the coupling device, and the coupling device comprises a guiding rib cooperating with the guiding groove so as to enable the seat to be detached in a specific direction.

9. The child chair of claim 1, wherein the engaging assembly comprises two engaging devices and two coupling devices, the two engaging devices are symmetrically mounted on both sides of the seat, and the two coupling devices are symmetrically mounted on the front leg.

10. The child chair of claim 1, wherein one of the seat and the upper front leg of the frame comprises a guiding track, the other one of the seat and the upper front leg of the frame comprises a guiding groove, and when the seat is detached from the frame, the guiding track moves in the guiding groove.

* * * * *